United States Patent [19]

Nakamura et al.

[11] Patent Number: 4,797,184

[45] Date of Patent: Jan. 10, 1989

[54] PROCESS FOR PRODUCING 7,7,8,8-TETRACYANOQUINODIMETHANE

[75] Inventors: Tomio Nakamura, Ichikawa; Katsuaki Kikuchi; Takeshi Inagaki, both of Yokohama, all of Japan

[73] Assignee: Nitto Chemical Industry Co., Ltd., Tokyo, Japan

[21] Appl. No.: 140,562

[22] Filed: Jan. 4, 1988

[30] Foreign Application Priority Data

Jan. 12, 1987 [JP] Japan ..... 62-3189

[51] Int. Cl.[4] ..... C25B 3/02

[52] U.S. Cl. ..... 204/59 R; 204/78

[58] Field of Search ..... 204/59 R, 78

[56] References Cited

U.S. PATENT DOCUMENTS

| | | | |
|---|---|---|---|
| 3,162,641 | 12/1964 | Acker et al. | 260/230 |
| 4,488,943 | 12/1984 | Shotheim | 204/58.5 |
| 4,640,748 | 2/1987 | Wodl et al. | 204/59 R |

OTHER PUBLICATIONS

J. Am. Chem. Soc., vol. 84, p. 3370 (1962).
Synthesis 135 (1976).

*Primary Examiner*—R. L. Andrews
*Attorney, Agent, or Firm*—Cushman, Darby & Cushman

[57] ABSTRACT

There is disclosed a process for producing 7,7,8,8-tetracyanoquinodimethane, which comprises subjecting 1,4-bis-(dicyanomethylene)-cyclohexane to anodic oxidation in a solvent.

6 Claims, No Drawings

PROCESS FOR PRODUCING 7,7,8,8-TETRACYANOQUINODIMETHANE

FIELD OF THE INVENTION

The present invention relates to a process for producing 7,7,8,8-tetracyanoquinodimethane (hereinafter to be abbreviated to TCNQ). More particularly, the present invention relates to a process for producing TCNQ at a high efficiency with formation of small amounts of by-products by subjecting 1,4-bis-(dicyanomethylene)-cyclohexane to electrochemical oxidation.

It is known that TCNQ which is an excellent electron acceptor exhibits various unique properties when used in combination with various electron donors. By utilizing these properties, practical applications of TCNQ are being developed in recent years in the fields of electron capacitor, photoconductive material, piezoelectric material, optical recording material, temperature sensor, etc.

RELATED ART

Various processes are known for production of TCNQ, such as a process of dehydrogenating 1,4-bis-(dicyanomethylene)-cyclohexane (hereinafter to be abbreviated to BDCC), a process of reacting 1,4-cyclohexadiene with carbonyl cyanide (Japanese Patent Publication No. 10666/1974) and a process of using diiodobenzene as a starting material [Tetrahedron Lett 26 1553 (1985)]. Of these, the process of dehydrogenating BDCC is said to be superior for industrial production of TCNQ.

As the process of dehydrogenating BDCC to TCNQ, there are known a process of allowing $Br_2$ or $Cl_2$ to act on BDCC in acetonitrile (hereinafter to be abbreviated to ATN) in the presence of a base such as pyridine or the like, a process of allowing N-bromosuccinimide to act on BDCC in ATN [J. Am. Chem. Soc. 84 3370 (1962), U.S. Pat. No. 3,162,641], and a process of heating BDCC with manganese dioxide in toluene [Synthesis 135 (1976)]. The process using a halogen must use a halogen and a base each in a large amount. The process of heating BDCC with manganese dioxide is inferior to the above process in the yield and purity of TCNQ obtained.

Of the above known processes of dehydrogenating BDCC, the process of allowing $Br_2$ or $Cl_2$ to act on BDCC in ATN in the presence of a base such as pyridine or the like to dehydrogenate BDCC is considered to be advantageous industrially. This process, however, has various drawbacks. That is, $Br_2$ or $Cl_2$ and the base are required each in a large amount; the base reacts with HBr or HCl to form a salt as a by-product; accordingly, the difficult recovery of not only the base but also $Br_2$ or $Cl_2$ disturbs their easy reusing.

SUMMARY OF THE INVENTION

The present inventors made extensive study in order to develop a process for producing TNCQ effectively without using an oxidizing agent such as $Br_2$ or $Cl_2$. As a result, it was found that BDCC can be oxidized and dehydrogenated to form TCNQ according to an electrochemical means which has been unknown heretofore.

The object of the present invention is to provide a process for producing TCNQ efficiently and economically with formation of small amounts of by-products by subjecting BDCC to anodic oxidation.

DETAILS OF PREFERRED EMBODIMENTS

The process of producing 7,7,8,8-tetracyanoquinodimethane according to the present invention is characterized in subjecting 1,4-bis-(dicyanomethylene)cyclohexane to anodic oxidation in a solvent.

The present invention will be described in detail below.

The process of the present invention is conducted by subjecting BDCC dissolved or suspended in a solvent to electrolytic oxidation in an electrolytic cell.

As the electrolytic cell, a beaker is generally used in a laboratory operation but industrially there can be used cells of various shapes and various materials such as FRP, polyethylene, polypropylene and resin-lined SUS.

As the material for the anode, there are used platinum, carbon, stainless steel (SUS), mercury, lead, lead oxide, nickel, nickel oxide, etc.

As the material for the cathode, there are used same materials as the anode materials, such as carbon and stainless steel (SUS).

The electrode shape is generally a plate or a rod. Various modifications can be added by, for example, imparting a network structure in order to allow each electrode to have a larger surface area. A composite electrode (a SPE electrode) can also be used.

It is possible to use a diaphragm in the electrolytic cell in order to prevent mixing of the catholyte and the anolyte. Use of the diaphragm is not requisite but is preferred to prevent reduction at the cathode of TCNQ formed at the anode. As the material for the diaphragm, there are used a porous porcelain, a glass filter, a porous plastic filter, asbestos, an ion-exchange membrane etc.

The solvent includes acetic acid, ATN, methanol, ethanol, tetrahydrofuran, dioxane, ethyl acetate, dimethylformamide, dimethyl sulfoxide, benzene, water, etc. They can be used singly or in combination, Of these solvents, there are preferred those having a high solubility for BDCC and additives which are mentioned later and having a low solubility for TCNQ.

It is possible to dissolve additives in the solvent in order to have an increased conductivity or to use it as a mediator. The additives include alkali metal salts of halogens such as NaCl, NaBr, NaI, LiCl, LiBr, LiI and the like, quaternary ammonium salts such as tetrabutylammonium bromide, tetrabutylammonium tetrafluoroborate, tetraethylammonium p-toluenesulfonate and the like, perchloric acid salts such as $LiClO_4$ and the like, acetic acid salts such as sodium acetate (AcONa), potassium acetate (AcOK) and the like, acids such as sulfuric acid ($H_2SO_4$), organic and inorganic bases such as triethylamine ($Et_3N$), pyridine, $Na_2CO_3$, NaOH, KOH and the like, etc. They can be used singly or in combination of two or more.

The total amount of the additive used is 0.01 to 50 times, preferably 0.05 to 20 times the weight of BDCC.

The concentration of BDCC is appropriately determined depending upon the solvent used but generally is 0.05 to 30% by weight, preferably 0.1 to 20% by weight based on the amount of the solvent.

The electrolytic reaction can be effected batchwise or continuously. In the batchwise reaction, a solvent, BDCC and additives are fed into the electrolytic cell and electricity is supplied with stirring. When a diaphragm is used in the electrolytic cell, a solvent, BDCC and additives are fed into the anode side, and the same solvent and the same additives are fed into the cathode side. It is not necessary that BDCC be completely dissolved in the solvent. BDCC may be in a slurry state in the solvent. In the continuous reaction, a solution of BDCC in a solvent or a low concentration slurry of BDCC in a solvent is continuously fed into the electrolytic cell (the anode side when a diaphragm is used).

The anode potential used in the reaction is appropriately determined depending upon the use or nonuse or type of the additives but generally is 0.3 to 20 V, preferably 0.5 to 5 V with reference to a saturated calomel electrode.

The amount of the electricity supplied can be 4 Faraday per mole of BDCC, (theoretical amount) to 6 Faraday per mole of BDCC but generally is slightly more than the theoretical amount.

The reaction temperature can be any temperature as long as the solvent remains to be liquid, but it is preferred to be 0° to 60° C., preferably 5° to 40° C. from the standpoints of the solubilities of BDCC, TCNQ and additives in solvent and the operability.

It is preferred that stirring be conducted according to, for example, a method using a stirrer, a method of circulating the reaction mixture or a method of blowing in a nitrogen gas.

Separation of TCNQ when the reaction is effected batchwise can be conducted by, after the supply of a necessary amount of electricity, filtering the reaction mixture to collect the formed TNCQ crystal. The filtrate can be reused as a reaction solvent. When a solvent of high solubility for TCNQ is used, the reaction mixture can be diluted with water to reduce the solubility for TCNQ and then filtered, whereby the amount of TCNQ recovered can be increased.

Separation of TCNQ when the reaction is effected continuously is conducted by taking the reaction mixture containing TCNQ out of the reaction system and filtering the mixture to collect TCNQ. The filtrate can be mixed with BDCC and fed back into the electrolytic cell.

Unlike the conventional process using an oxidizing agent such as $Br_2$ or $Cl_2$, the present process uses no oxidizing agent and accordingly produces no salt of large amount as a by-product. Hence, TCNQ formed is low in by-product content and has a very high purity. Further, the present process virtually uses only BDCC as the main raw material and therefore is substantially improved in raw material cost.

The present invention will be described specifically by way of Examples. However, the present invention is in no way restricted to these Examples.

EXAMPLE 1

Electrolysis was carried out in a glass electrolytic cell comprising an anode compartment equipped with a platinum plate as an anode and a magnetic stirrer, a cathode compartment equipped with a carbon rod cathode, and a porous porcelain separating the anode and the cathode.

Into the anode compartment were fed 0.42 g (2 mmol) of BDCC, 2.1 g of sodium bromide, 1.6 g of sodium acetate and 100 g of 90% aqueous acetic acid. Into the cathode compartment were fed 1.0 g of sodium bromide and 50 g of a 90% aqueous acetic acid. Constant potential electrolysis was carried out at room temperature at a potential of 1 V with reference to a saturated calomel electrode. The current density was 13.5 to 8 mA/cm$^2$. After 8.1 mF of electricity was passed over 5 hours, 400 g of water was added to the anolyte. The product was isolated by filtration, washed with water and dried. TCNQ was obtained as 0.36 g (yield: 89%) of yellow powder.

EXAMPLE 2

The same electrolysis as in Example 1 was carried out. After the electrolysis, the produt was isolated by filtration without adding water, washed with water and dried. 0.25 g (yield: 61%) of TCNQ was obtained.

EXAMPLE 3

Electrolysis was carried out in the same manner as in Example 1 except that the mixture of filtrate in Example 2 and 0.42 g of BDCC were placed in the anode compartment, whereby 0.37 g (yield: 91%) of TCNQ was obtained.

EXAMPLE 4

Electrolysis was carried out in the same manner as in Example 1 except that a carbon rod anode was used, whereby 0.36 g (yield: 89%) of TCNQ was obtained.

EXAMPLE 5

Electrolysis was carried out in the same manner as in Example 1 except that ATN was used in place of the 90% aqueous acetic acid solution, whereby 0.27 g (yield: 65%) of TCNQ was obtained.

EXAMPLE 6

Electrolysis was carried out in the same manner as in Example 1 except that instead of maintaining the anode potential of 1 V with reference to the saturated calomel electrode, the current density was maintained at 12.5 mA/cm$^2$ (the anode potential: 1.0 to 1.5 V), whereby 0.39 g (yield: 95%) of TCNQ was obtained.

EXAMPLE 7

Electrolysis was carried out in the same manner as in Example 1. As an exception to Example 1, the anode was maintained at a potential of 2.5 V with reference to a saturated calomel electrode, and the current density was 90 to 55 mA/cm$^2$. 11.4 mF of electricity was passed in 2 hours. TCNQ was obtained as 0.34 g (yield: 84%) of an yellowish green powder of TCNQ.

What is claimed is:

1. A process for producing 7,7,8,8-tetracyanoquinodimethane, which comprises subjecting 1,4-bis-(dicyanoethylene)-cyclohexane to anodic oxidation in a solvent.

2. A process according to claim 1, wherein the solvent is at least one solvent selected from acetic acid, acetonitrile, methanol, ethanol, tetrahydrofuran, dioxane, ethyl acetate, dimethylformamide, dimethyl sulfoxide and benzene.

3. A process according to claim 1, wherein the solvent contains as an additive at least one compound selected from alkali metal salts of halogens, quaternary ammonium salts, perchloric aicd salts, acetic-acid salts, inorganic acids and organic or inorganic bases.

4. A process according to claim 1, wherein the anodic oxidation is conducted at an anode potential of 0.3 to 20 V with reference to a saturated calomel electrode.

5. A process according to claim 1, wherein the anodic oxidation is conducted using a diaphragm between the anode and the cathode.

6. A process according to claim 1, wherein the diaphragm is selected from a porous porcelain, a glass filter, a porous plastic filter, asbestos and an ion-exchange membrane.

* * * * *